US006249075B1

(12) United States Patent
Bishop et al.

(10) Patent No.: US 6,249,075 B1
(45) Date of Patent: Jun. 19, 2001

(54) SURFACE MICRO-MACHINED ACOUSTIC TRANSDUCERS

(75) Inventors: David John Bishop, Summit; Robert Albert Boie, Westfield; Flavio Pardo, New Providence, all of NJ (US)

(73) Assignees: Lucent Technologies Inc., Murray Hill, NJ (US); Agere Systems

( * ) Notice: Subject to any disclaimer, the term of this patent is extended or adjusted under 35 U.S.C. 154(b) by 0 days.

(21) Appl. No.: 09/442,984

(22) Filed: Nov. 18, 1999

(51) Int. Cl.[7] ..... G01L 1/16; G01L 1/18; H01L 41/053; H01L 41/113

(52) U.S. Cl. ..... 310/338; 310/328; 29/25.35

(58) Field of Search ..... 310/328, 338; 29/25.35

(56) References Cited

U.S. PATENT DOCUMENTS

| | | | | |
|---|---|---|---|---|
| 4,481,967 | | 11/1984 | Frick | 137/85 |
| 4,675,960 | * | 6/1987 | Higgins | 29/25.35 |
| 4,827,459 | * | 5/1989 | Franklin | 310/337 |
| 4,853,669 | | 8/1989 | Guckel et al. | 338/4 |
| 5,165,289 | | 11/1992 | Tilmans | 73/862.59 |
| 5,424,650 | | 6/1995 | Frick | 324/688 |
| 5,569,968 | | 10/1996 | Lal et al. | 310/322 |
| 5,573,679 | | 11/1996 | Mitchell et al. | 216/2 |
| 5,578,759 | * | 11/1996 | Clayton | 310/338 |
| 5,621,399 | | 4/1997 | Gruler | 340/870.37 |
| 5,733,670 | | 3/1998 | Takeuchi et al. | 428/699 |
| 5,796,508 | | 8/1998 | Suzuki | 359/224 |
| 5,825,119 | * | 10/1998 | Shibata et al. | 310/338 |
| 5,828,138 | | 10/1998 | McIver et al. | 307/10 |

FOREIGN PATENT DOCUMENTS

| | | | | |
|---|---|---|---|---|
| 2-86865 | * | 3/1990 | (JP) | 310/338 |

OTHER PUBLICATIONS

Scheeper et al., *Sensors and Actuators*, "A Review of Silicon Microphones", pp. 1–11, (1994).

Pister et al., *Sensors and Actuators*, "Microfabricated Hinges", pp. 249–256, (1992).

Thompson, *IRE Transactions on Instrumentation*, "The Precise Measurement of Small Capacitances", vol. 1–7, pp. 245–253, Dec. 1958.

Pedersen et al., *Sensors and Actuators*, "A Silicon Condenser Microphone With Polymide Diaphragm and Backplate", p. 97–104, (1997), Dec. 1997.

Lee et al., *Journal of Microelectromechanical Systems*, "Piezoelectric Cantilever Microphone and Microspeaker", vol. 5, pp. 238–242, Dec. 4, 1996.

Bergqvist et al., *Sensors and Actuators*, "A Silicon Condenser Microphone Using Bond and Etch–Back Technologu", pp. 115–124, (1994), Dec. 1994.

Thielemann et al., *Sensors and Actuators*, "Inorganic Electret Membrane for a Silicon Microphone", pp. 352–355, (1997), Dec. 1997.

Bourouina et al., *Sensors and Actuators*, "A New Condenser Microphone With a P+ Silicon Membrane", pp. 149–152, (1992), Dec. 1992.

Pedersen et al., *Sensors and Actuators*, "An Integrated Silicon Capacitive Microphone With Frequency–Modulatred Digial Output", pp. 267–275, (1998), Dec. 1998.

Scheeper et al., *Sensors and Actuators*, "Improvement of the Performance of Microphones with a Silicon Nitride Diaphragm and Backplate", pp. 179–186, (1994), Dec. 1994.

* cited by examiner

*Primary Examiner*—Thomas M. Dougherty
(74) *Attorney, Agent, or Firm*—Richard J. Botos

(57) ABSTRACT

A micro-machined transducer having a structure in which an acoustic enclosure is formed on a substrate above the plane of the substrate surface is disclosed. Forming the acoustic enclosure on the substrate above the plane of the substrate surface, rather than an acoustic cavity in a surface of the substrate, provides an acoustic cavity whose size is not limited by the thickness of the substrate.

23 Claims, 4 Drawing Sheets

SURFACE MICRO-MACHINED ACOUSTIC TRANSDUCERS

FIELD OF THE INVENTION

The present invention relates to acoustic transducers and more specifically to, micro-machined acoustic transducers.

DESCRIPTION OF THE RELATED ART

Transducers are devices which convert input energy in one form into output energy in another form. For example, microphones are acoustic transducers that convert input acoustic energy into output electrical energy. Micro-machined acoustic transducers are miniature transducers (sub-centimeter in size) fabricated with techniques commonly used for making integrated circuits (e. g., material deposition/growth, lithography, and etching). Potential uses for micro-machined acoustic transducers include microphones for hearing aids and pressure sensors for automobiles. Scheeper, P. R., et al. "A Review of Silicon Microphones", *Sensors and Actuators*, Vol. A 44 (1994) pp. 1–11, describes several micro-machined transducers suitable for converting acoustic signals into electrical signals. A cross-sectional view of one such micro-machined acoustic transducer 1 is shown in FIG. 1. Micro-machined acoustic transducer 1 includes a membrane 4 and substrate 3. The substrate 3 has an acoustic cavity 7 formed in a surface thereof. The membrane 4 is attached to the substrate 3 and covers the acoustic cavity 7.

Micro-machined acoustic transducer 1 converts input acoustic signals into output electrical signals. In particular, when acoustic signals 5 (e. g., sound waves) impinge on membrane 4, the impinging acoustic signals apply a force thereto. The force applied by the acoustic signals impinging on the membrane 4 causes the portion of the membrane 4 covering the acoustic cavity 7 to vibrate. The membrane 4 vibrates relative to the surface of the substrate 3. Thus, the impinging acoustic signals are converted into mechanical energy (i. e. membrane vibration).

The amount of acoustic energy that is transformed into mechanical energy depends on the amount of force applied to the membrane 4 by the impinging acoustic signals 5 as well as the physical properties associated with the membrane material (e. g., thickness, elastic properties, and tensile strength).

The mechanical displacement imparted to the membrane 4 by the impinging acoustic signals 5 is converted to an electrical signal using for example strain gauges (not shown) or by detecting changes in the capacitance between the membrane 4 and an electrode (not shown). Thereafter, the electrical signal is amplified and filtered.

One problem with some micro-machined transducers is related to the depth of the acoustic cavity 7. Since the acoustic cavity 7 is formed in the surface of the substrate 3, the thickness of the substrate 3 limits the depth of such cavity 7. The depth of the acoustic cavity 7 is related to the compressibility of a gas (e.g., air) confined therein. The compressibility of a confined gas refers to the ability of such gas to be displaced in response to the application of a force. For example, when an impinging acoustic signal applies a force to a membrane confining a gas in a cavity formed in a substrate, the membrane is displaced x(t) as $$x(t) = \frac{V(p(t) - p_0)}{p_0} \tag{1}$$

where V is the volume of the cavity, $p_0$ is the initial pressure both in and out of the cavity, and p(t) is the pressure of the sound wave at time t. Based on equation 1, as the depth of the cavity becomes smaller, the membrane vibrates less. When the membrane vibrates less in response to acoustic signals impinging thereon, the amount of input acoustic energy that gets converted to mechanical energy and output as electrical energy is reduced.

Thus, micro-machined transducers continue to be sought.

SUMMARY OF THE INVENTION

The present invention is directed to an acoustic micro-machined transducer having a structure wherein an acoustic enclosure is formed on a substrate above the plane of the substrate surface. Forming the acoustic enclosure on the substrate above the plane of the substrate surface, rather than an acoustic cavity in a surface of the substrate, provides an acoustic cavity with a size that is not limited by the thickness of the substrate.

The acoustic enclosure formed on the substrate surface is defined by a plurality of enclosure sides. Since the acoustic enclosure is on the surface of the substrate, the bottom enclosure side is a portion of the substrate surface. Examples of suitable geometrical shapes for the acoustic enclosure include polyhedrons such as tetrahedrons and cubes.

At least two enclosure sides are in hinged attachment with each other to form the enclosure. At least one enclosure side is in hinged attachment with the substrate.

At least one enclosure side is adapted to receive acoustic energy by having an acoustic membrane formed therein. The acoustic membrane is attached with beams to the enclosure side. Attaching the acoustic membrane to the enclosure side with beams, means that the physical properties associated with the membrane (e. g., tensile strength, elastic properties, dependence, thereby increasing the conversion of acoustic signals into electrical signals.

The acoustic membrane moves rigidly in response to acoustic signals impinging thereon. The acoustic membrane is made of one or more layers of material. Examples of suitable materials for the acoustic membrane include polysilicon, silicon nitride, and silicon dioxide.

When the acoustic membrane moves in response to acoustic signals impinging thereon, the beams attaching such membrane to the enclosure side are displaced. transforming the acoustic energy of the acoustic signals into mechanical energy. The amount of acoustic energy transformed into mechanical energy depends on the physical properties (e.g., tensile strength, elastic properties, layer thickness) associated with the beams.

A detector is coupled to the acoustic membrane. The detector measures the mechanical energy imparted to the beams from the impinging acoustic signals. Piezoelectric devices, piezoresistive devices, and capacitive devices are examples of detectors suitable for measuring the mechanical energy imparted to the acoustic membrane.

The detector is also coupled with electronics which convert the mechanical energy measured thereby into electrical energy. Examples of electronics suitable for converting mechanical energy into electrical energy include amplifiers, modulators/demodulators, and filters.

In one embodiment of the present invention, the enclosure sides are formed on a surface of a substrate. The enclosure sides are formed on the surface of the substrate by depositing one or more material layers on the substrate followed by defining in them a desired geometrical shape which can be assembled to form the enclosure. The one or more material layers are deposited on the substrate and defined in the desired geometrical shape with techniques (e. g., lithography, evaporation, etching) typically used for making integrated circuits.

The one or more material layers used to form the enclosure sides have a tensile strength which prevents the enclosure sides from significantly bowing. The tensile strength of the one or more material layers depends on the composition as well as the thickness thereof. Examples of suitable materials for the one or more material layers include polysilicon, silicon nitride, silicon dioxide, and metals.

The substrate is made of a material typically used for integrated circuit fabrication. Examples of such substrate materials include silicon and quartz.

The geometrical shape of each enclosure side defined in the one or more material layers depends on the shape of the acoustic enclosure. Examples of suitable shapes for the enclosure sides are square, rectangular, and triangular.

The enclosure sides are in hinged attachment with each other and with the substrate. The hinges permit the enclosure to be formed by pivoting the enclosure sides with respect to each other and with respect to the substrate surface. The hinges are formed with fabrication techniques (e. g., evaporation, lithography and etching) typically used for making integrated circuits.

An acoustic membrane is formed on at least one of the enclosure sides. The acoustic membrane is formed by depositing one or more material layers on an enclosure side followed by defining in them a desired configuration suitable for receiving acoustic energy. The acoustic membrane is formed with fabrication techniques (e. g., evaporation, lithography and etching) typically used for making integrated circuits.

The detector is formed on the acoustic membrane. The detector is formed by depositing one or more material layers on at least a portion of the acoustic membrane followed by defining in them a desired configuration suitable for detecting mechanical energy. The detector is formed with fabrication techniques (e. g., evaporation, lithography and etching) typically used for making integrated circuits.

After the acoustic membrane and the detector are formed in at least one enclosure side, the acoustic enclosure is assembled on the surface of the substrate. The enclosure is assembled by lifting the enclosure sides away from the surface of the substrate. The enclosure sides are lifted away from the surface of the substrate with fabrication techniques (e. g., etching) typically used for making integrated circuits.

Other objects and features of the present invention will become apparent from the following detailed description considered in conjunction with the accompanying drawings. It is to be understood, however, that the drawings are designed solely for purposes of illustration and do not serve to limit the invention, for which reference should be made to the appended claims.

DETAILED DESCRIPTION

The present invention is directed to a micro-machined transducer having a structure wherein an acoustic enclosure is formed on a substrate above the plane of the substrate surface. Forming the acoustic enclosure on the substrate above the plane of the substrate surface, rather than an acoustic cavity in a surface of the substrate, provides an acoustic cavity having a size not limited by the thickness of the substrate.

Figure 2:
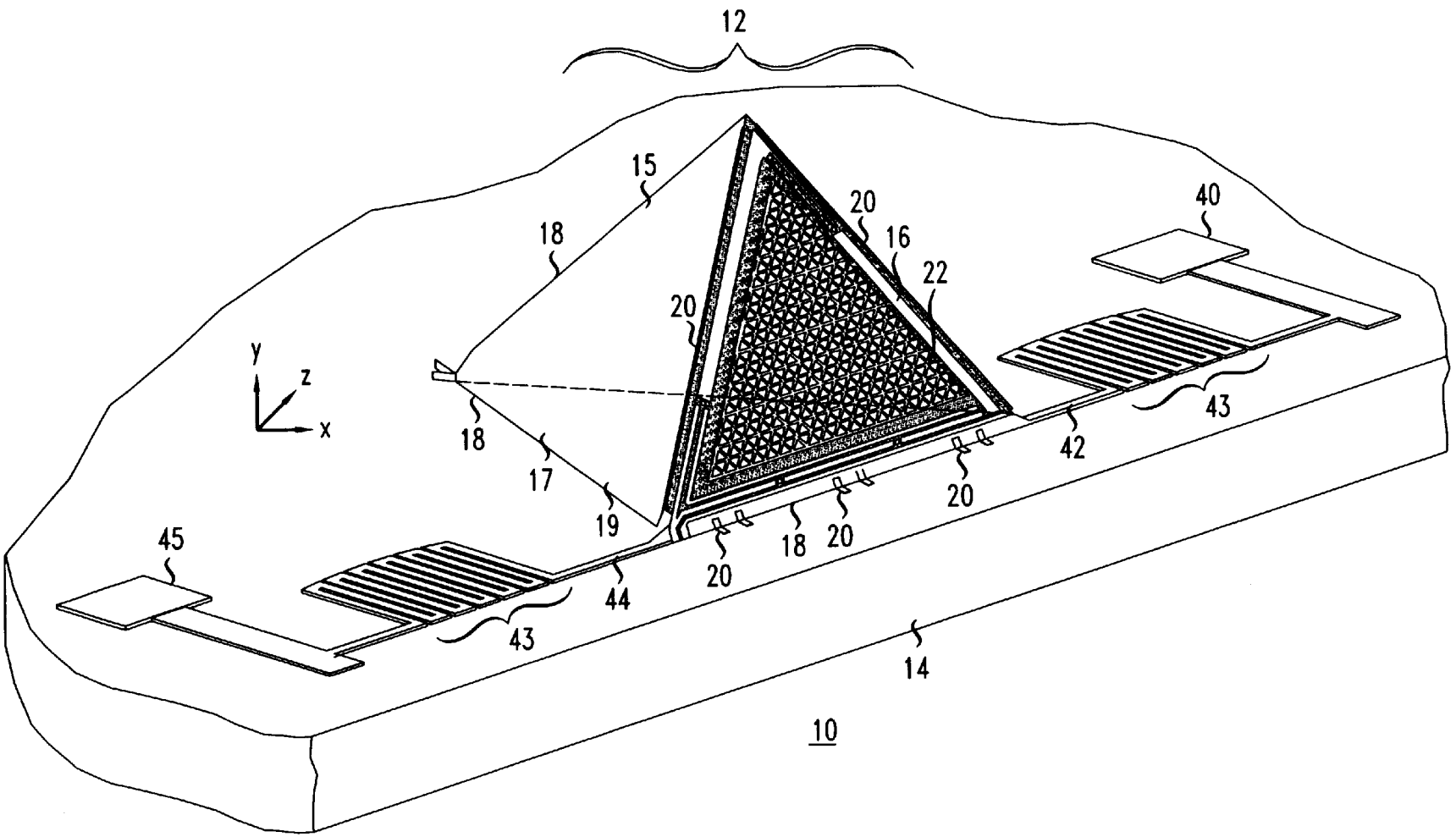
FIG. 2 depicts a micro-machined transducer of the present invention wherein an acoustic enclosure is formed on a surface of a substrate.

As shown in FIG. 2, the micro-machined transducer 10 includes an acoustic enclosure 12 formed on the surface of a substrate 14. The acoustic enclosure 12 is defined by a plurality of enclosure sides 15, 16, 17, 19.

In the embodiment depicted in FIG. 2, acoustic enclosure 12 has a tetrahedral shape, with three enclosure sides 15, 16, 17 positioned at angles of about 60 degrees relative to the surface of the substrate. The fourth enclosure side 19 is defined by a portion of the surface of the substrate 14. Examples of other suitable geometrical shapes for the acoustic enclosure 12 include polygons such as cubes and hexagons.

At least two enclosure side 15, 16, 17 are in hinged attachment with each other to form the enclosure 12. At least one enclosure side 16 is in hinged attachment with the substrate 14. Illustrative hinges suitable for attaching the enclosure sides 15, 16, 17 to one another and/or to the surface of the substrate 14 are discussed in U. S. Pat. Nos. 5,828,138; and 5,796,508; see also Pister et al., "Microfabricated Hinges", *Sensors and Actuators*, Vol. A 33, (1992), pp. 249–256.

At least one enclosure side is adapted to receive acoustic energy by having an acoustic membrane formed therein. The acoustic membrane vibrates in response to acoustic signals impinging thereon. The size and shape of the acoustic membrane depends on the size and the shape of the enclosure side adapted to receive the acoustic energy.

The acoustic membrane is made of one or more layers of material. Suitable material layers have physical properties (e.g., tensile strength, elastic properties, layer thickness) which permit the acoustic membrane to vibrate in response to acoustic signals impinging thereon. Examples of suitable materials for the acoustic membrane include polysilicon, silicon nitride, and silicon dioxide.

When the one or more material layers of the acoustic membrane vibrate in response to acoustic signals impinging thereon, the acoustic energy of such acoustic signals is transformed into mechanical energy. The amount of acoustical energy transformed into mechanical energy varies depending on the magnitude of the impinging acoustic signals as well as the physical properties (e.g., tensile strength, elastic properties, layer thickness) associated with the one or more material layers of acoustic membrane.

A detector is coupled to the acoustic membrane. The detector measures the mechanical energy imparted to the acoustic membrane from the impinging acoustic signals. Piezoelectric devices, piezoresistive devices, and capacitive devices are examples of detectors suitable for measuring the mechanical energy imparted to the acoustic membrane. Illustrative piezoelectric devices are discussed in U. S. Pat. Nos. 5,569,968 and 5,733,670; piezoresistive devices are discussed in U. S. Pat. Nos. 4,853,669 and 5,165,289; and capacitive devices are discussed in U. S. Pat. No. 5,573,679.

Referring to FIG. 2, enclosure side 16 is adapted to receive acoustic energy in region 22. Enclosure side 16 optionally includes a plurality of regions 22 (not shown).

Figure 1:
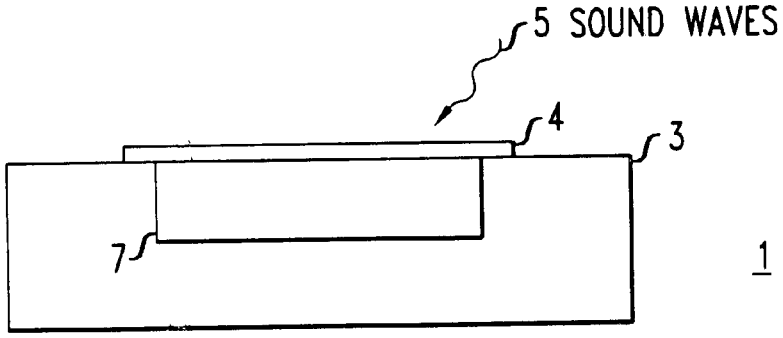
FIG. 1 (PRIOR ART)
FIG. 1 is a cross-sectional view of a micro-machined transducer having an acoustic cavity formed in the surface of a substrate.
Figure 3:
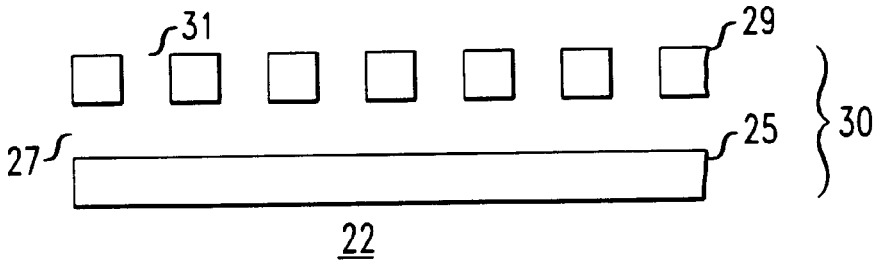
FIG. 3 is a cross-sectional view of a region of a side of the acoustic enclosure shown in FIG. 2 configured to receive acoustic energy.

FIG. 3 depicts a cross-sectional view of region 22 of enclosure side 16. In region 22, an capacitive detector 30 is coupled to an acoustic membrane 25. The capacitive detector 30 includes an electrode 29 that is separated by an air gap 27 from the acoustic membrane 25.

The electrode 29 is on the outer portion of enclosure side 16, while the acoustic membrane 25 is the inner portion thereof. The structure of region 22 is optionally reversed so that the electrode 29 is on the inner portion of the enclosure side 16, while the acoustic membrane 25 is the outer portion thereof.

The electrode 29 has passages 31 therethrough. Acoustic signals are transmitted through the passages 31 to impinge on the acoustic membrane 25. The density of passages 31 through electrode 29 is preferably greater than about 70%. Passage 31 densities less than about 70% are undesirable because such densities can prevent acoustic signals from impinging on the acoustic membrane 25.

The amount of mechanical energy imparted to the acoustic membrane 25 from impinging acoustic signals is measured by applying a bias voltage to electrode 29, while measuring changes in the capacitance between the vibrating acoustic membrane 25 and electrode 29. The amount of bias voltage applied to electrode 29 depends on the composition and thickness of the electrode 29. The applied bias voltage is limited to a maximum value. Based on the size of the air gap 27 separating the acoustic membrane 25 from the electrode 29, when the bias voltage is above a certain value the acoustic membrane 25 will collapse onto electrode 29. When the acoustic membrane 25 collapses onto the electrode 29, the acoustic membrane 25 no longer vibrates, and the capacitive changes between such acoustic membrane 25 and electrode 29 can no longer be measured.

Referring to FIGS. 2 and 3, leads 42, 44 electrically couple pads 40, 45 to region 22 of enclosure side 16. The bias voltage is applied and the capacitance changes measured by the circuit defined by leads 42, 44, pads 40, 45, and region 22. For example, when the bias voltage is applied to electrode 29 from pad 40 along lead 42, changes in the capacitance between the vibrating acoustic membrane 25 and electrode 29 are output to pad 45 along lead 44.

Leads 42, 44 optionally include a spring 43. When the acoustic enclosure 12 is assembled on the surface of the substrate 14, stresses are applied to leads 42, 44 as the enclosure sides 15, 16, 17 are lifted off the surface of the substrate 14. These stresses can break leads 42, 44, thereby decoupling pads 40, 45 from enclosure side 16. Decoupling pads 40, 45 from enclosure side 16 prevents the measurement of capacitive changes between the acoustic membrane 25 and electrode 29 as well as the application of a bias voltage to the electrode 29. Springs 43 absorb the stresses applied to leads 42, 44 as the acoustic enclosure 12 is assembled, preserving the coupling between the enclosure side 16 and pads 40, 45.

The detector is also coupled with electronics which convert the measured mechanical energy into electrical energy. Referring to FIG. 2, the circuit defined by leads 42, 44, pads 40, 45, and region 22 may be connected with RF circuitry (not shown) which converts the mechanical energy into an electrical signal (see Thompson, A. M., "The Precise Measurement of Small Capacitance", *IRE Transactions on Instrumentation*, Vol. 1–7, (1959), pp. 245–253). Electronics suitable for converting mechanical energy into electrical energy include amplifiers, modulators/demodulators, and filters. Illustrative circuits are discussed in U. S. Pat. Nos. 5,621,399; 5,424,650; and 4,481,967.

In one embodiment of the present invention, the enclosure sides are formed in a planar arrangement on a surface of a substrate. The enclosure sides are formed in a planar arrangement on the surface of the substrate by depositing one or more material layers on the substrate followed by defining in them a desired geometrical shape which can be assembled to form the enclosure. The one or more material layers are deposited on the substrate and defined in the desired geometrical shape with techniques (e. g., lithography, evaporation, etching) typically used for making integrated circuits.

The one or more material layers have a tensile strength which prevents enclosure sides defined therein from significantly bowing when assembled to form the enclosure. The tensile strength of the one or more material layers depends on the composition as well as the thickness of such material layers. Examples of suitable materials for the one or more material layers include polysilicon, silicon nitride, silicon dioxide, and metals.

The substrate is made of a material typically used for integrated circuit fabrication. Examples of such substrate materials include silicon and quartz.

Figure 4:
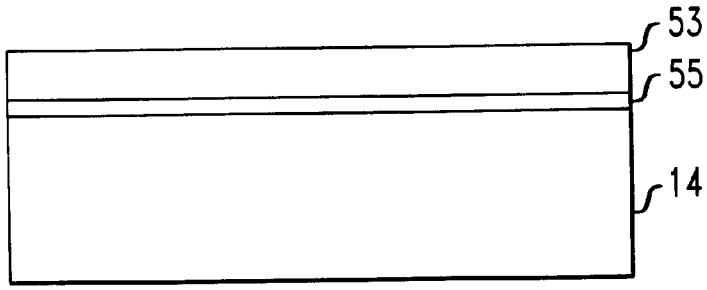
FIG. 4 is a cross-sectional view of one or more material layers formed on a surface of a substrate which are useful for making enclosure sides.

FIG. 4 depicts a cross-sectional view of a portion of substrate 14. One or more material layers 53 are deposited over a sacrificial layer 55 on the surface thereof. After the one or more material layers 53 are deposited on the substrate 14, desired geometrical shapes defining the enclosure sides are formed therein. The enclosure sides are formed with fabrication techniques (e. g., lithography and etching) typically used for making integrated circuits. The specific geometrical shape of the enclosure sides varies according to the shape of the assembled enclosure. Examples of suitable geometrical shapes for the enclosure sides are square, rectangular, and triangular.

Figure 5:
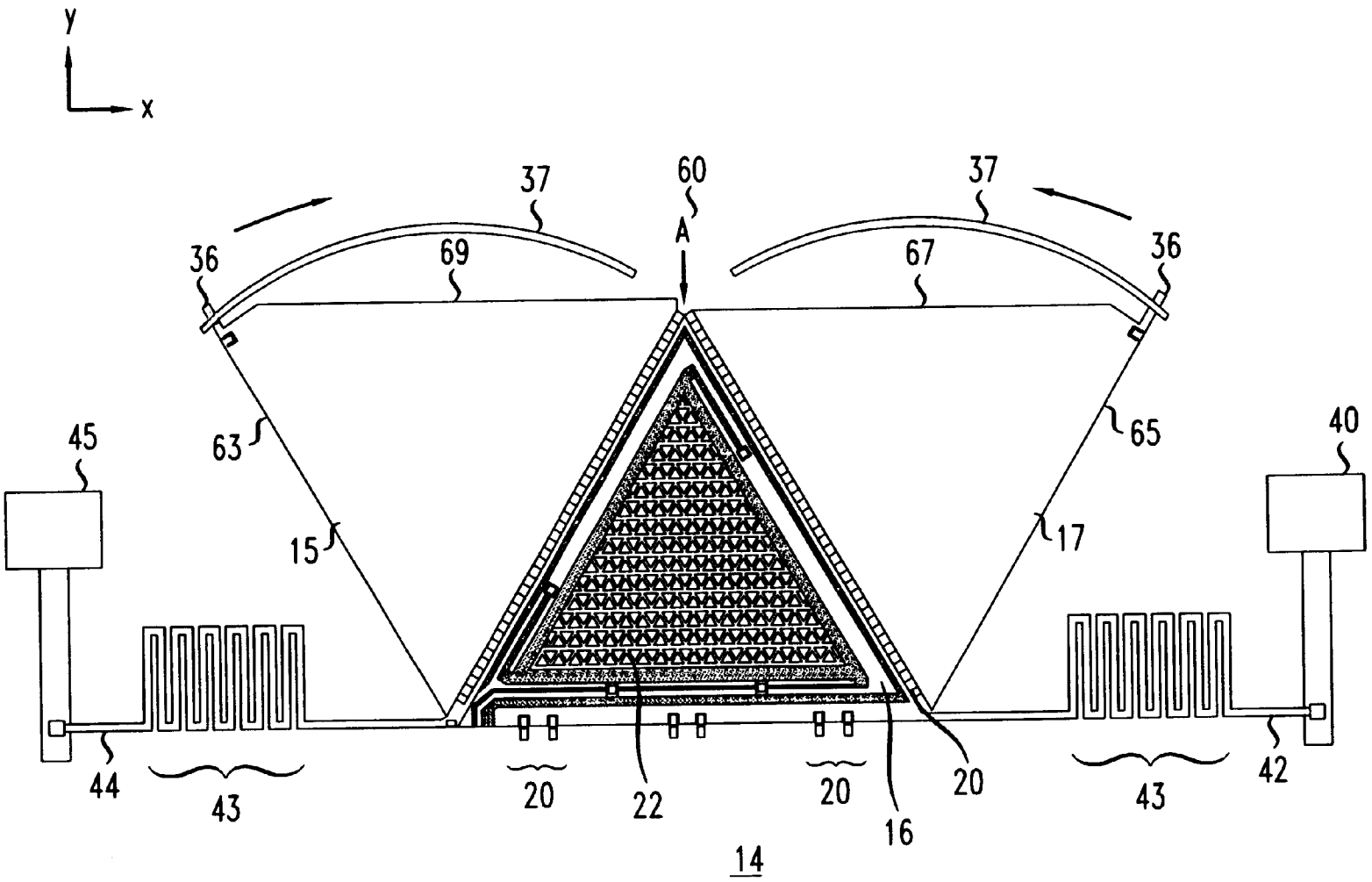
FIG. 5 is a top view of the one or more material layers shown in FIG. 4 in which three triangular enclosure sides are formed.

FIG. 5 is a top view of the enclosure sides in planar arrangement defined in material layer 53 (FIG. 4). Three enclosure sides 15, 16, 17 are formed over the sacrificial layer 55 on the surface of the substrate 14. Enclosure sides 15, 16, 17 each have a triangular shape.

The enclosure sides 15, 16, 17 are in hinged attachment 20 with each other and with the substrate 14. The hinges permit the enclosure to be formed by pivoting the enclosure sides with respect to each other and with respect to the substrate surface. The hinges are formed with fabrication techniques (e. g., evaporation, lithography and etching) typically used for making integrated circuits.

Tabs 36 are optionally attached to a corner of each enclosure side 15, 17 not attached to the substrate 14 with hinges 20. Guides 37 are formed over the tabs 36. The guides 37 are material strips which extend over a portion of the substrate 14 along a path traversed by tabs 36 during enclosure assembly. The guides 37 prevent enclosure sides 15, 17 from lifting off the substrate and folding over onto adjacent enclosure side 16. In addition, pads 40, 45, leads 42, 44, and springs 43 are also formed on the surface of the substrate. The tabs, pads, leads, and springs are formed with fabrication techniques (e. g., evaporation, lithography and etching) typically used for making integrated circuits.

Figure 6A:
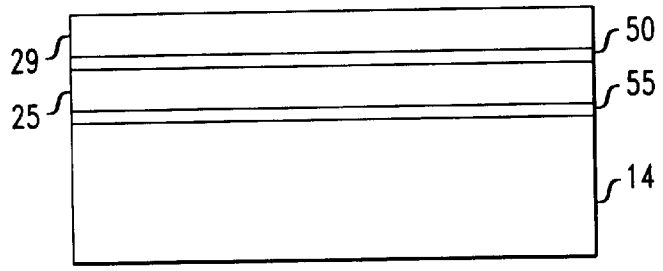
FIG. 6A is a cross-sectional view of one or more material layers formed on a surface of a substrate which are useful for making an enclosure side configured to receive acoustic energy.

After the enclosure sides are formed, an acoustic membrane and a detector are formed on at least one enclosure side. FIG. 6A depicts a cross-sectional view of a portion of region 22 of enclosure side 16 (FIG. 5) configured to receive acoustic energy. An acoustic membrane 25 and an electrode 29, are formed over sacrificial layers 50, 55 on the surface of the substrate 14. The acoustic membrane 25 is formed over sacrificial layer 55 on the substrate 14 and is separated from the electrode 29 by sacrificial layer 29.

The acoustic membrane 29 is formed by depositing one or more material layers on an enclosure side followed by defining in them a desired configuration suitable for receiving acoustic energy. The acoustic membrane is formed with fabrication techniques (e. g., evaporation, lithography and etching) typically used for making integrated circuits. Suitable material layers have physical properties (e.g., tensile strength, elastic properties, layer thickness) which permit the acoustic membrane to vibrate in response to acoustic signals impinging thereon. Examples of suitable materials for the acoustic membrane include polysilicon, silicon nitride, and silicon dioxide.

The detector is electrode 29. The electrode 29 is formed by depositing one or more material layers on at least a portion of the acoustic membrane followed by defining in them a desired configuration suitable for detecting mechanical energy. The electrode 29 is formed with fabrication techniques (e. g., evaporation, lithography and etching) typically used for making integrated circuits. Examples of suitable materials for the electrode include polysilicon, silicon nitride, silicon dioxide, and metals.

Figure 6B:
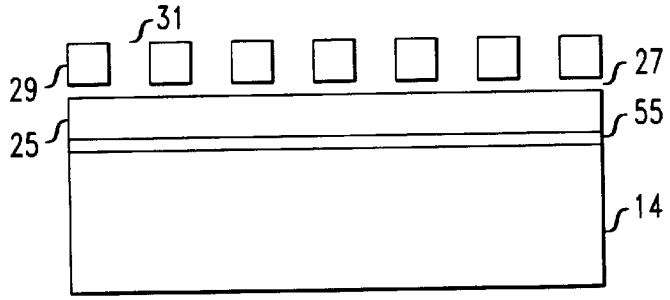
FIG. 6B shows the one or more material layers depicted in FIG. 6A formed into an acoustic membrane separated from an electrode by an air gap.

When the electrode 29 forms an outer portion of enclosure side 16, passages 31 through electrode 29 as well as an air gap 27 between the electrode 29 and the acoustic membrane 25 are formed, as shown in FIG. 6B. The passages and the air gap allow acoustic signals to impinge on the acoustic membrane.

The passages 31 are formed with fabrication techniques (e.g., lithography and etching) typically used for making integrated circuits. After the passages 31 are formed through the electrode 29, the air gap 27 between the electrode 29 and the acoustic membrane 25 is formed by removing sacrificial layer 50. Sacrificial layer 50 is removed, for example by etching such layer 50 with a suitable etchant. After the sacrificial layer 50 is removed, electrode 29 is supported at it periphery by enclosure side 16 (FIG. 5).

After the acoustic membrane and the detector are formed in at least one enclosure side, the acoustic enclosure is assembled on the surface of the substrate. The acoustic enclosure is assembled by removing sacrificial layer 55 (see FIGS. 4 and 6B). When sacrificial layer 55 is removed, the enclosure sides 15, 16, 17 are held on the surface of the substrate with tabs 36 and guides 37, however they are not attached to the substrate 14 surface. Sacrificial layer 55 is removed, for example by etching such layer 55 with a suitable etchant.

After sacrificial layer 55 is removed, the enclosure is assembled by lifting at least a portion of one enclosure side off the surface of the substrate. For example, referring to FIG. 5, when a portion of enclosure side 16 is lifted off the substrate at point A, denoted as 60, enclosure sides 15, 16, 17 start to pivot relative to one another and to the surface of the substrate 14, lifting each enclosure side off the surface of the substrate. As enclosure sides 15, 17 are lifted off the surface of the substrate, tabs 36 move across the surface of the substrate 14 under guides 37 toward point A. The guides 37 prevent edges 63, 65 of enclosure sides 15, 17 respectively, from folding over onto adjacent enclosure side 16. When tabs 36 reach point A, edges 67, 69 of enclosure sides 15, 17, respectively are adjacent to one another forming the enclosure 10 shown in FIG. 2.

One suitable method for lifting the enclosure sides off the surface of the substrate uses an ultrasonic bath. In particular, the substrate having the enclosure sides thereon is placed in an ultrasonic bath. The ultrasonic bath is preferably operated at a frequency less than about 500 Hz. Frequencies greater than about 500 Hz are undesirable because such frequencies are large enough to break the hinges connecting enclosure sides with one another.

The following example is provided to illustrate a specific embodiment of the present invention.

EXAMPLE 1

An acoustic enclosure having the tetrahedral shape depicted in FIG. 2 was formed. The acoustic enclosure was formed on a surface of a silicon substrate. The silicon substrate had a 2 $\mu$m (micrometers) thick silicon dioxide sacrificial layer over a 600 nm (nanometer) thick silicon nitride layer formed thereon.

A 2 $\mu$m polysilicon layer having a tensile strength of about 3 Mpa was formed on the silicon dioxide sacrificial layer. Three triangular enclosure sides 15, 16, 17 attached one to another with hinges 20, as illustrated in FIG. 5, were defined in the polysilicon layer. The edges of each enclosure side 15, 16, 17 had a length of about 650 $\mu$m (micrometers).

After the enclosure sides 15, 16, 17 were defined in the 2 $\mu$m thick polysilicon layer, enclosure side 16 was configured to receive acoustic energy in triangular region 22. First, an acoustic membrane was defined in a region of the 2 $\mu$m thick polysilicon enclosure side 16. Thereafter, an 800 nm thick silicon dioxide sacrificial layer was deposited on the acoustic membrane followed by a 1.5 $\mu$m thick polysilicon layer having a tensile strength of about 7 MPa.

A capacitive electrode was defined in the 1.5 $\mu$m thick polysilicon layer. The capacitive electrode had 10 $\mu$m diameter passages formed therethrough. The density of the passages formed in the electrode was about 90%.

After the 10 $\mu$m diameter passages were formed through the capacitive electrode, the 800 nm sacrificial layer was selectively removed to form an 800 nm air gap between the acoustic membrane and the capacitive electrode.

Pads 40, 45, leads 42, 44, springs 43, tabs 36, and guides 37 were also formed on the silicon substrate. The square pads 40, 45 were formed by depositing a 500 nm thick polysilicon layer followed by a 55 nm thick chromium/gold layer on a silicon nitride coated region of the silicon substrate. Thereafter, square pads 40, 45 about 100 $\mu$m×100 $\mu$m were defined in the chromium/gold layers.

Leads 42, 44, springs 43, and tabs 36 were formed on the silicon dioxide sacrificial layer in a 2 $\mu$m polysilicon layer having a tensile strength of about 3 MPa. Guides 37 were also formed on the silicon dioxide sacrificial layer over tabs 36 in a 1.5 $\mu$m polysilicon layer having a tensile strength of about 7 MPa.

Each fabrication step mentioned above was performed at the MEMS Technology Application Center, MCNC, Research Triangle Park, N.C.

The acoustic enclosure was assembled by removing the silicon dioxide sacrificial layer, so that enclosure sides 15, 16, 17 were held on the silicon substrate with the tabs 36 and guides 37, but not attached to the surface thereof. The silicon dioxide sacrificial layer was removed by immersing the substrate in a $HF/H_2O$ (1:20) solution.

After the silicon dioxide sacrificial layer was removed, the acoustic enclosure was formed by placing the silicon substrate in a ultrasonic bath. The ultrasonic bath was agitated at a frequency of about 150 Hz.

Figure 7:
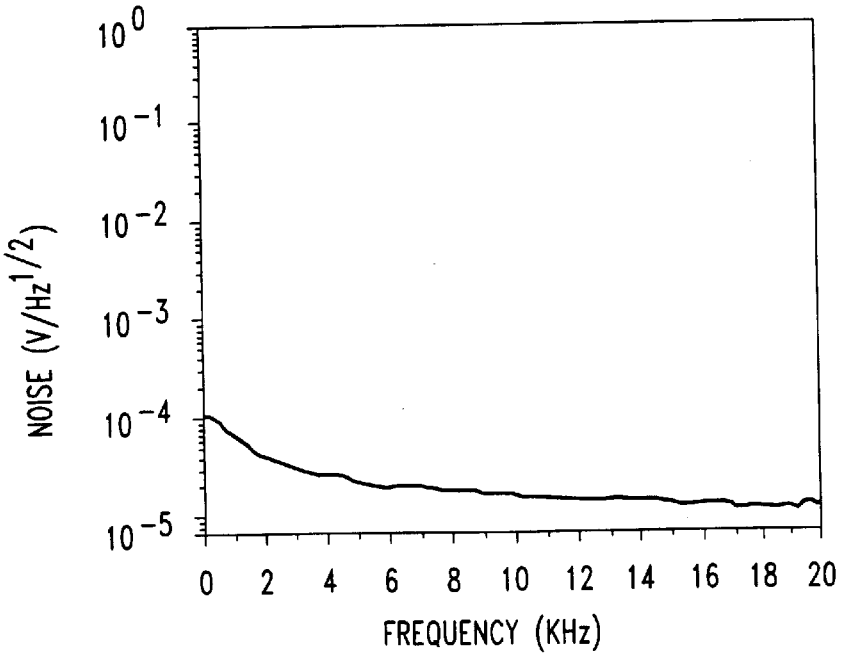
FIG. 7 is a graph of the noise level of an acoustic enclosure of Example 1 plotted as a function of frequency.

The noise level of the acoustic enclosure was measured in a Brüel & Kjær 4222 Anechoic Test Chamber. The noise level was measured in a frequency bandwidth from about 100 Hz to about 20 kHz bandwidth. FIG. 7 is a graph of the noise level for the acoustic enclosure plotted as a function of frequency. FIG. 7 illustrates that at a frequencies between about 100 Hz to about 20 kHz the acoustic enclosure has a noise level of about 100 $\mu V/Hz^{-1/2}$ to about 1 $\mu V/Hz^{-1/2}$, which means acoustic signals larger than about 72 dB SPL (decibels sound pressure level) are detectable.

The invention claimed is:

1. A micro-machined transducer, comprising an enclosure formed on a substrate above the plane of the substrate surface, wherein the enclosure has a plurality of enclosure sides, and wherein at least one enclosure side is adapted to receive acoustic energy;

a detector coupled to the at least one enclosure side adapted to receive acoustic energy, wherein the detector is configured to measure the received acoustic energy; and one or more electronic converters coupled to the detector, wherein the one or more electronic converters are configured to convert the measured acoustic energy into electrical energy.

2. The micro-machined transducer of claim 1 wherein the at least one enclosure side adapted to receive acoustic energy has an acoustic membrane therein.

3. The micro-machined transducer of claim 1 wherein the detector is selected from the group consisting of a piezoelectric device, a piezoresistive device, and a capacitive device.

4. The micro-machined transducer of claim 1 wherein each enclosure side is made of one or more material layers.

5. The micro-machined transducer of claim 4 wherein the one or more material layers are selected from the group consisting of silicon nitride, silicon dioxide, polysilicon, and metal.

6. The micro-machined transducer of claim 1 wherein at least two enclosure sides are in hinged attachment with each other.

7. The micro-machined transducer of claim 1 wherein one enclosure side includes a portion of the substrate surface.

8. The micro-machined transducer of claim 1 wherein at least one enclosure side is in hinged attachment with the substrate.

9. The micro-machined transducer of claim 1 wherein the one or more electronic converters are selected from the group consisting of an amplifier, a filter, and a modulator.

10. An acoustic system, comprising:

a micro-machined transducer, wherein the micro-machined transducer includes a) an enclosure formed on a substrate above the plane of the substrate surface, wherein the enclosure has a plurality of enclosure sides, and wherein at least one enclosure side is adapted to receive acoustic energy;

b) a detector coupled to the at least one enclosure side adapted to receive acoustic energy, wherein the detector is configured to measure the received acoustic energy; and c) one or more electronic converters coupled to the detector, wherein the one or more electronic converters are configured to convert the measured acoustic energy into electrical energy.

11. The acoustic system of claim 10 wherein the at least one enclosure side adapted to receive acoustic energy has an acoustic membrane therein.

12. The acoustic system of claim 10 wherein the detector is selected from the group consisting of a piezoelectric device, an piezoresistive device, and a capacitive device.

13. The acoustic system of claim 10 wherein the one or more electronic converters are selected from the group consisting of an amplifier, a filter, and a modulator.

14. A method of making a micro-machined transducer, comprising the steps of:

providing a substrate, wherein the substrate has one or more material layers thereon;

forming a plurality of enclosure sides in the one or more material layers on the substrate, wherein at least one enclosure side is adapted to receive acoustic energy, wherein at least two enclosure sides are in hinged attachment with each other, and wherein at least one enclosure side is in hinged attachment with the substrate; and assembling a micro-machined transducer on the substrate by lifting the plurality of enclosure sides off the surface of the substrate.

15. The method of claim 14 further comprising coupling a detector to the at least one enclosure side adapted to receive acoustic energy, wherein the detector is configured to measure the received acoustic energy.

16. The method of claim 15 wherein the detector is selected from the group consisting of a piezoelectric device, a piezoresistive device, and a capacitive device.

17. The method of claim 15 further comprising coupling one or more electronic converters to the detector, wherein the one or more electronic converters are configured to convert the measured acoustic energy into electrical energy.

18. The method of claim 17 wherein the one or more electronic devices are selected from the group consisting of an amplifier, a filter, and a modulator.

19. The method of claim 14 wherein the enclosure sides are lifted of the surface of the substrate using an ultrasonic bath.

20. The method of claim 19 wherein the ultrasonic bath is agitated at a frequency less than about 500 Hz.

21. The method of claim 14 wherein the one or more material layers on the substrate are selected from the group consisting of silicon nitride, silicon dioxide, polysilicon, and metal.

22. The method of claim 14 wherein the one or more material layers on the substrate include a sacrificial layer.

23. The method of claim 22 wherein the sacrificial layer is removed prior to assembling the micro-machined transducer on the substrate such that the enclosure sides are only in hinged attachment to the substrate and to each other.

* * * * *